United States Patent [19]

Debruycker et al.

[11] Patent Number: 4,846,721

[45] Date of Patent: Jul. 11, 1989

[54] TELECOMMUNICATIONS TERMINAL BLOCK

[75] Inventors: Erwin Debruycker; Thomas Hunter, both of Cary; Jim Pinyan, Apex; Emanuele Scalco, Cary, all of N.C.

[73] Assignee: Raychem Corporation, Menlo Park, Calif.

[21] Appl. No.: 157,442

[22] Filed: Feb. 17, 1988

[51] Int. Cl.[4] ..... H01R 4/24

[52] U.S. Cl. ..... 439/411

[58] Field of Search ..... 439/411–413, 439/715, 722, 725, 801

[56] References Cited

U.S. PATENT DOCUMENTS 2,930,021 3/1960 Hasselhorn et al. ..... 439/413

3,902,780 9/1975 Dola ..... 439/411

*Primary Examiner*—Joseph H. McGlynn

*Attorney, Agent, or Firm*—A. Stephen Zavell; Herbert G. Burkard

[57] ABSTRACT

A telecommunications terminal block has binding posts and caps that are a screw-fit thereon. The binding posts lie in apertures that contain a sealing material. Drop-wires are connected to the posts by inserting them through further apertures that communicate with those in which the posts lie, and tightening down the caps onto them. Displaced sealing material is received into a third aperture.

17 Claims, 1 Drawing Sheet

TELECOMMUNICATIONS TERMINAL BLOCK

FIELD OF THE INVENTION

The present invention relates to a terminal block by means of which a conductor of a multi-core cable can be connected to a drop wire. The invention may be used for making other electrical connections but it will have this capability.

BACKGROUND OF THE INVENTION

A multi-core telecommunications cable may have many tens or hundreds of conductor pairs, and some means may be required for terminating such a cable for final connection to drop wires that lead to, for example, subscriber's telephones.

Various types of terminal blocks have been used for this purpose, each containing some means for anchoring an incoming multi-core cable and having a number of pairs of conductors, known as binding posts, to a base of each of which a conductor of the cable is more or less permanently connected. A top part of each binding post protrudes above an upper surface of the block, and is screw threaded. A stripped drop-wire may be wrapped around the exposed binding post and secured with a washer and nut, thus making a breakable-electrical connection between a core of the incoming cable and the drop-wire. A terminal block may typically provide for connections of up to 25 pairs of conductors, a pair of conductors of course being required for each telephone.

An improved terminal block is disclosed in U.S. Pat. application No. 70,475 filed 7 July 1987 (Shimirak, Huynh), the disclosure of which is incorporated herein by reference. That improved terminal block comprises:

an insulative housing containing a plurality of spaced-apart conductive binding posts;

conductive binding posts having opening means therein for receiving insulated wires; and caps on the binding posts;

wherein:

the insulative housing has first opening means therein aligned with the opening means in the binding posts whereby an insulated wire is received through the opening in the housing and into the opening in the binding posts; and the binding posts have thread means for engaging a threaded cap and have first shoulder means positioned between the threaded means and the opening means for engaging opposite shoulder means in the cap and have second shoulder means positioned on the opposite side of the opening means which second shoulder means is adapted for supporting the wire when pressure is applied to the wire by the cap threaded onto the binding posts; and the caps have a conductive inner portion and an insulative outer portion wherein the conductive inner portion has thread means adapted to engage the thread means on the binding posts and has shoulder means at the end of said thread means for engaging the first shoulder means of the binding posts and has bottom edge means for engaging the wire positioned in the opening means of the binding posts and compressing the wire against the second should means of the binding posts as the cap is tightened on the binding posts whereby the edge means contacts a conductor in the wire by passing through insulation on the wire;

wherein the distance between the shoulder means in the cap and the edge means of the cap is such that when the should means in the cap seats against the first shoulder means of the binding posts the distance between the edge means of the cap and the second shoulder means of the binding post is a preselected distance which allows connection of the edge means of the cap through the insulation of the wire to a conductor in the wire without breaking or severing the wire; and wherein the housing has second opening means positioned substantially at right angles to said wire receiving openings through which second opening means the binding post extends and adapted for receiving the caps therethrough.

The binding posts and wire connected thereto may be sealed with a sealing material such as a gel, preferably having an ultimate elongation of at least 200%, and a cone penetration value of about 100 to about 350 ($10^{-1}$ mm).

A further instance in which such a sealing material is used in conjunction with a termination block is disclosed in U.S. Pat. No. 4,600,261 (Debbaut), the disclosure of which is incorporated herein by reference. In that instance a gel is retained in one or more caps that are then positioned over binding posts, such that the gel is maintained under compression.

German Gebrauchsmuster G8514551 (Raychem) also discloses the use of such a gel to seal an electrical connection, but in this case a coaxial cable is sealed within a socket of a cable television (CATV) splitter box. The socket is provided with an expansion chamber or other means for accommodating gel that is displaced as the coaxial cable is pushed in place. The gel may automatically move back when the cable is withdrawn.

The situation in the case of a terminal block is rather different, since the proper positioning of a cap on a binding post may cause a sealing material to be driven out of the aperture through which a drop-wire enters. This may be messy, unsightly, and result in sufficient loss of gel that on subsequent use of the terminal in question a reliable seal is not achieved.

SUMMARY OF THE INVENTION

We have now designed a terminal block that allows displacement of sealing material as a cap is installed on a binding post, but which is able to retain the material and, if desired, return it to its original position, preferably automatically on removal of the cap.

Thus, the present invention provides a terminal block by means of which a conductor of a multi-core cable can be connected to a drop-wire, which comprises a housing having a connection means having:

(a) a first aperture capable of receiving a sealing material;

(b) a binding post within the first aperture, and to which a conductor of the cable can be electrically connected;

(c) a second aperture that communicates with the first aperture and which is capable of receiving the drop-wire such that the drop-wire extends into the first aperture;

(d) a cap that can be received on the binding post such that a part of the cap is received in the first aperture and can make electrical contact between the binding post and the drop-wire extending into the first aperture; and (e) a third aperture in communication with the first aperture and capable of receiving sealing material displaced from the first aperture by receipt of the cap on the binding post.

DETAILED DESCRIPTION OF THE INVENTION

The terminal block preferably comprises a monolithic insulating block having the various apertures therein, and having the binding post molded or otherwise positioned therein, onto which the cap can be received. The terminal block may, however, comprise more than one piece, for example a base carrying the binding post, together with a device that may be positioned thereon and in which the apertures are formed. In this way, the invention may be applied to a prior art terminal block, which would then function as the base referred to.

The terminal block housing preferably has from 4–30, more preferably 5–25 pairs of said connection means, which may be arranged for example as a single row or as two or more rows.

The terminal block may be part of, by being housed in or adjacent, some protective enclosure. For example, it may be part of a cable splice enclosure. In this instance, two (or more) multi-core telecommunications cables are spliced together, at which point several conductors of one of the cables, say 25 pairs of conductors, will be connected to a terminal block of the invention, rather than to the other cable. The splice enclosure may provide an environmental seal around both the cable splice and the terminal block. Preferably the cable splice, which should require little or no attention, is sealed in a more permanent way or is merely less accessible, than the terminal block, which may require access for testing of or for re-routing of drop-wires. The splice may be environmentally sealed in a separate enclosure from that sealing the terminal block, which two enclosures may be provided with means for holding them together. A similar situation may arise where conductors are broken out of a single length of cable, example by removing an intermediate length of cable jacket. Here there is no main cable splice, but an auxiliary multi-core cable (say of 25 pairs) may be spliced into the main cable. As before, there is a need to provide environmental sealing around the main cable where cable jacket is missing.

The cable splice enclosure may be generally cylindrical with the main cable entering and leaving at opposite ends, or it may be generally cylindrical with the cable entering and leaving through the same end, and looped around inside the closure (for example a pedestal closure) or it may be generally rectangular such as many pole-mounted closures. One or more terminal blocks of the invention may be used in any of these closures.

The binding post and the cap of the block of the invention are preferably screw threaded so that the cap may be screwed onto the binding post. Preferably the cap has insulation-displacement means, for example a lower cutting edge, such that when it is screwed, or otherwise received, on to the binding post over an insulated drop-wire it can make contact with a core of the drop-wire through insulation thereof. We prefer that the drop-wire be retained, generally by the second aperture, such that electrical connection to the drop-wire is broken when the cap is unscrewed a certain distance. This allows connection between a drop-wire and the corresponding conductor of the multi-core cable to be broken at will, allowing circuit tests to be made selectively towards the subscriber (for example by using a probe to the drop-wire) and towards the central office (for example, by using a probe to the binding post or cap).

The first aperture and the cap, or the binding post and the cap, may be so configured (or other means may be provided) to limit the extent to which the cap is screwed on to the binding post. In this way safe insulation-displacement may be achieved without a core of the drop-wire being severed or excessively damaged. For example, the cap may ground on the top of or on a shoulder of the binder post, or the first aperture may have a shoulder or a base on which the bottom of the cap grounds.

The sealing material may be supplied within, or capable of being placed in, the first aperture. The drop-wire, at least when fully received within the second aperture penetrates the sealing material, as does the cap when installed, so that the insulation-displacement occurs surrounded by the sealing material, or the sealing material is later displaced to cover the exposed drop-wire core, and preferably also binding post and cap, or suitable parts thereof. If desired, the sealing material may first be positioned in or attached to the cap.

As the cap is screwed down onto the binding post the sealing material is displaced into the third aperture, through its communication with the first aperture. As a result excessive loss through the second aperture may be avoided. This selective displacement of sealing material may be ensured in any one or more of at least two ways. Firstly, the third aperture may have a minimum cross-sectional size greater than the minimum difference between the cross-sectional size of the second aperture and that of a drop-wire to be received therein. Terminal blocks are designed and sold for specific applications where specific sizes of drop-wires are to be used, and it will generally be clear whether this requirement is met. The minimum cross-sectional size of the third aperture may for example be at least 50%, particularly at least 100% of the second aperture.

A second technique for ensuring selective displacement of sealing material is choice of the positioning of the communication of the second and third apertures with the first, and choice of the angles of the second and third apertures. We prefer that the third aperture break into the first at a position lower down the first aperture than that at which the second breaks in. The third aperture preferably breaks into the first adjacent the bottom of the first. In this way, communication between the second aperture and the first may be reduced by receipt of the cap on the binding post to a greater extent than communication between the third and the first aperture is thus reduced.

A further feature may also be provided, and it may result from the second aperture breaking into the first near its base. This further feature is displacement of sealing material from the third aperture back into the first aperture when the cap is released from the binding post by rotation of the cap. A portion of the cap, for example a cylindrical skirt (a bottom cutting edge of which may provide insulation-displacement), may drag sealing material from the third aperture as it is rotated across, or adjacent, its opening.

The third aperture may be open only at its communication with the first aperture. Air trapped in the third aperture may then resist displacement of the sealing material and maintain the sealing material under compression around the surfaces to be protected and this may be beneficial. Any blind end to the third aperture may have a removable cap or plug. Removal may be useful for adding sealing material or electrical testing, etc. It will generally be desirable that the third aperture be of greater volume than the volume of sealing material displaced by receipt of the cap on the binding post.

A preferred sealing material comprises a gel, for example based on polyurethane or silicone. As an example a material may be mentioned that is made by gelling curable polyurethane precursor materials in the presence of substantial quantities of mineral oil, vegetable oil or plasticizer or a mixture of two or more of them. Also, a suitable material may be made by curing reactive silicones with non-reactive extender silicones. The material may contain additives such as moisture scavengers (e.g. benzoyl chloride), antioxidants, pigments and fungicides. The material is preferably electrically-insulating and hydrolytically-stable.

We prefer a sealing material having a cone penetration value as measured according to ASTM D216-68 at 21° C. of 100–350 ($10^{-1}$ mm), more preferably 150–350, especially 200–300 ($10^{-1}$ mm). Cone penetration is measured on an undisturbed sample using a standard 1:1 scale cone (cone weight 102.5 g, shaft weight 42.5 g) the penetration being measured after 5 seconds. The material preferably has an ultimate elongation as measured according to ASTM D638-80 at 21° C. of at least 200%, preferably at least 500%, especially at least 750%. In the measurement of elongation, a Type 4 die is used to cut the sample, and elongation is measured at 50 cm per minute. We have found with such materials it is possible to provide excellent encapsulation of the binding posts, caps and/or drop-wires etc., particularly if the material is maintained under compression (a method was mentioned above), and that the material can be substantially cleanly removed from them for inspection or repair etc.

DETAILED DESCRIPTION OF THE DRAWINGS

Figure 1:
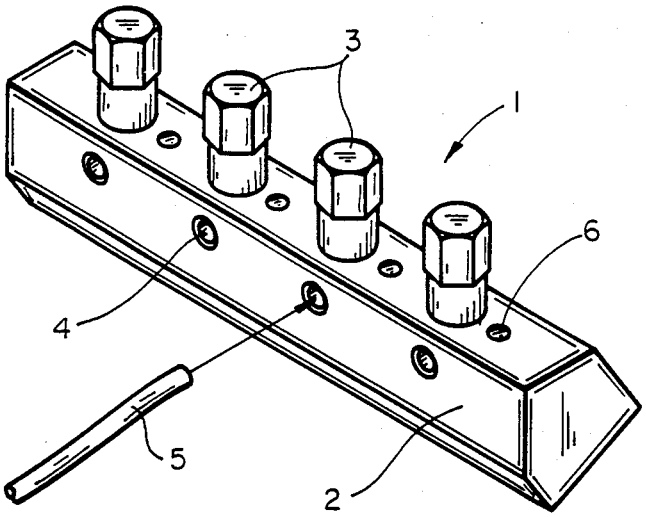
FIG. 1 is a perspective view of a terminal block having four connection means.

FIG. 1 shows a terminal block 1 comprising a housing 2 having four connection means for two pairs of drop-wires. A cap 3 is shown received on a binding post and partially within a first aperture, the binding post and first aperture therefore being invisible in the drawing. A second aperture 4 for receiving a drop-wire 5 is shown, and it can be seen that aperture 4 communicates with the aperture within which a part of cap 3 is received. When cap 3 is tightened down to the position shown, a bottom edge of the cap can contact a core of a drop-wire within an aperture 4. A third aperture 6 also communicates with the aperture within which a part of the cap 3 is received, and it is into this third aperture 6 that sealing material may be displaced when the cap is screwed down onto the binding posts.

The third aperture 6 is shown on a top face of the housing 2, but it may appear at any surface of the housing, or be blind and therefore not appear at all. For example, it may appear at the back (i.e. at a face opposite to that of aperture 4) or it may appear at the underside of the block.

Figure 2:
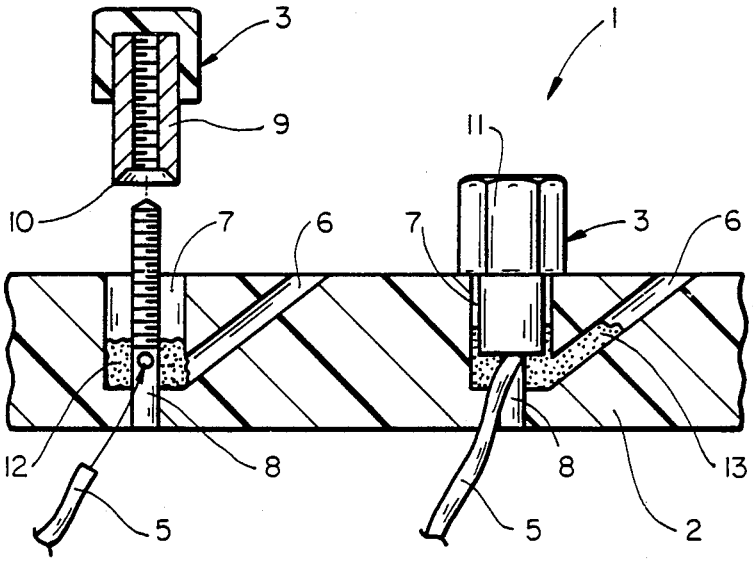
FIG. 2 is a longitudinal partial cross-section through a part of the block of FIG. 1.

FIG. 2 is a partial cross-section through a part of the block of FIG. 1, showing two first apertures 7 having binding posts 8 therein. The cap 3 has a skirt or other part 9 that will be received within the first aperture 7, a bottom edge of which part bears an insulation displacing cutting edge 10. A drop-wire 5 is positioned through the second aperture 4 (see FIG. 1) and through a hole in the binding post 8 as indicated by the arrow leading from the drop-wire 5 in FIG. 2, alternatively, the second aperture 4 may retain the drop-wire 5 alongside the binding post. The first aperture 7 contains a sealing material 12 such as a gel, which can be seen, by comparing the left- and right-hand halves 1 of FIG. 2, to be displaced into the third aperture 6 on installation of cap 3. When the cap 3 is unscrewed, the part 9 thereof preferably drags the sealing material out of the third aperture 6 from the position indicated as 13. Preferably when the cap is fully removed from the binding post, the sealing material is substantially cleanly left behind in the first aperture 7 as shown in the left-hand half of the figure. Alternatively, the cap and apertures may be so designed that the sealing material is retained on or in the cap.

We claim:

1. A terminal block by means of which a conductor of a multi-core cable can be connected to a drop-wire, which comprises a housing having a connection means having:

(a) a first aperture capable of receiving a sealing material;

(b) a binding post within the first aperture, and to which a conductor of the cable can be electrically connected;

(c) a second aperture that communicates with the first aperture and which is capable of receiving the drop-wire such that the drop-wire extends into the first aperture;

(d) a cap that can be received on the binding post such that a part of the cap is received in the first aperture and can make electrical contact between the binding post and the drop-wire extending into the first aperture; and (e) a third aperture in communication with the first aperture and capable of receiving sealing material displaced from the first aperture by receipt of the cap on the binding post.

2. A terminal block according to claim 1, in which each of the binding posts and cap is threaded such that the cap may be screwed onto the binding post.

3. A terminal block according to claim 1, in which the cap has insulation-displacement means such that when it is received on the binding post over an insulated said drop-wire it can make contact with a core of the drop-wire through insulation thereof.

4. A terminal block according to claim 1, in which the third aperture communicates with the first aperture at a position adjacent a closed end of the first aperture.

5. A terminal block according to claim 1, in which the cap can be released from the binding post by rotation of the cap, and the third aperture communicates with the first aperture at such a position that said rotation of the cap can cause sealing material to be displaced from the third aperture into the first aperture.

6. A terminal block according to claim 1, in which the third aperture is open only at its communication with the first aperture.

7. A terminal block according to claim 1, in which the connection means additionally has:

(f) a sealing material.

8. A terminal block according to claim 7, in which the sealing material comprises a gel having a cone penetration value as measured according to ASTM D217-68 at 21° C. of 100-350 ($10^{-1}$ mm), and an ultimate elongation as measured by ASTM D638-80 at 21° C. of at least 200%.

9. A terminal block according to claim 7, in which the volume of the third aperture is greater than the volume of said sealing material that is displaced by receipt of the cap on the binding post.

10. A terminal block according to claim 7, in which the sealing material is provided in the first aperture such that it blocks communication to the second aperture and is penetrated by the drop-wire when fully received therein.

11. A terminal block according to claim 1, in which the housing has at least two said connection means.

12. A terminal block according to claim 11, in which the terminal block has from 4–30 pairs of said connection means.

13. A terminal block according to claim 1, in which the minimum cross-sectional size of the third aperture is greater than the minimum difference between the cross-sectional size of the second aperture and that of a drop-wire to be received therein.

14. A terminal block according to claim 1, in which the minimum cross-sectional size of the third aperture is at least 50% of that of the second aperture.

15. A terminal block according to claim 14, in which the minimum cross-sectional size of the third aperture is at least 100% of that of the second aperture.

16. A terminal block according to claim 1, in which communication between the second aperture and the first aperture is reduced by receipt of the cap on the binding post to a greater extent than communication between the third and the first aperture is thus reduced.

17. A terminal block according to claim 1, being part of a cable splice enclosure.

* * * * *